US007219679B2

(12) United States Patent
Hsu et al.

(10) Patent No.: US 7,219,679 B2
(45) Date of Patent: May 22, 2007

(54) DUAL-PURPOSE CANE

(75) Inventors: Meng-Hui Hsu, No. 949 Ta Wan Rd., Yung Kang City, Tainan County (TW); Hsueh-Yu Chen, Yung Kang (TW); Bing-Hung Lin, Tainan (TW); Cheng-De Hong, Chaojhou Township, Pingtung County (TW); Sheng-Wei Lin, Taichung (TW); Danver Wang, Rueifang Township, Taipei County (TW)

(73) Assignee: Meng-Hui Hsu, Tainan County (TW)

( * ) Notice: Subject to any disclaimer, the term of this patent is extended or adjusted under 35 U.S.C. 154(b) by 0 days.

(21) Appl. No.: 11/388,340

(22) Filed: Mar. 23, 2006

(65) Prior Publication Data

US 2006/0213545 A1 Sep. 28, 2006

(51) Int. Cl.
*A45B 5/00* (2006.01)
*A45B 3/00* (2006.01)

(52) U.S. Cl. ..... 135/66; 135/65; 135/78; 248/155.1

(58) Field of Classification Search ..... 135/65–66, 135/78, 80; 248/155, 155.1, 155.2, 155.3; 297/108

See application file for complete search history.

(56) References Cited

U.S. PATENT DOCUMENTS

| | | | | | |
|---|---|---|---|---|---|
| 952,335 | A | * | 3/1910 | Killian | 248/155.1 |
| D113,534 | S | * | 2/1939 | Bodkin | D3/7 |
| 2,560,447 | A | * | 7/1951 | Jansen | 248/155.1 |
| 2,793,680 | A | * | 5/1957 | Eben | 248/155.1 |
| 6,192,908 | B1 | * | 2/2001 | Smith | 135/66 |

FOREIGN PATENT DOCUMENTS

| | | | |
|---|---|---|---|
| JP | 08332107 | A | * 12/1996 |
| JP | 2001025405 | A | * 1/2001 |
| JP | 2003061721 | A | * 3/2003 |
| JP | 2003325215 | A | * 11/2003 |
| JP | 2004344609 | A | * 12/2004 |

* cited by examiner

*Primary Examiner*—Winnie Yip
(74) *Attorney, Agent, or Firm*—Pro-Techtor Int'l Services

(57) ABSTRACT

Disclosed is a dual-purpose cane, which includes a shaft unit, a handgrip unit, which is provided at the top side of the shaft unit and alternatively set between a first mode for use as a handgrip and a second mode for use as a seat, and a footpiece unit, which is provided at the bottom side of the shaft unit and alternatively set between a received position for enabling the cane to be used as a walking stick and an extended position for enabling the cane to be used as a chair.

7 Claims, 8 Drawing Sheets

DUAL-PURPOSE CANE

BACKGROUND OF THE INVENTION

1. Field of the Invention

The present invention relates a cane for walking and more particularly, to a dual-purpose cane that can be alternatively set between a first mode for use as a walking stick and a second mode for use as a chair.

2. Description of the Related Art

A conventional cane is a walking aid for supporting a handicapped person to walk. A cane can also be used as a mountaineer's aid when climbing a mountain. A conventional cane is simply a stick with a handgrip at the top for gripping. When a handicapped person walked with a cane for a certain distance, the handicapped person may need to take a rest. However, it is difficult to find a seat or suitable place on the way for sitting. US Design Pat. D400,724 disclosed a design of cane with a seat. This design comprises a plurality of frame bars and a seat. When the frame bars are gathered together, the device is used as a walking stick. When the frame bars are extended out, the extended frame bars support the seat above the ground for sitting. This structure of cane is functional, however it requires much storage space when collapsed. Because of bulky structure, the design of cane is not suitable for use as a mountaineer's aid when climbing a mountain.

SUMMARY OF THE INVENTION

The present invention has been accomplished under the circumstances in view. It is the main object of the present invention to provide a dual-purpose cane, which can be alternatively set between a first mode for use as a walking stick and a second mode for use as a chair. It is another object of the present invention to provide a dual-purpose cane, which has a compact size convenient for storage or delivery. It is still another object of the present invention to provide a dual-purpose cane, which can be used as a walking aid when walking or a mountaineer's aid when climbing a mountain. It is still another object of the present invention to provide a dual-purpose cane, which provides illumination. To achieve these and other objects, the dual-purpose cane comprises a shaft unit, a footpiece unit, and a handgrip unit. The shaft unit comprises a barrel, a shaft, an extension rod, a push rod, a spring member, a locking ring, and a guide pin. The barrel has a top axial center hole and a bottom axial center hole axially connected in line and respectively extending through the top and bottom ends thereof. The bottom axial center hole has a diameter greater than the top axial center hole. The shaft is a tubular member mounted inside the barrel, having an upper part, a lower part, and a transverse partition set between the upper part and the lower part. The lower part has a longitudinal sliding slot. The extension rod is coupled to the upper part of the shaft and axially movable relative to the shaft. The spring member is inserted into the lower part of the shaft and stopped at the transverse partition. The push rod is inserted into the lower part of the shaft and stopped at the spring member against the transverse partition. The locking ring has a longitudinal sliding slot, and is set in the bottom axial center hole of the barrel and sleeved onto the periphery of the lower part of the shaft. The guide pin is transversely inserted through the longitudinal sliding slot of the shaft and the longitudinal sliding slot of the locking ring and fixedly connected with two distal ends thereof to the barrel. The footpiece unit comprises a plurality of legs and a plurality of links. The legs each have a top end respectively pivoted to a bottom end of the shaft. The links each have a top end respectively pivoted to the bottom end of the push rod and a bottom end respectively pivoted to the legs. The handgrip unit comprises a plurality of support frame bars, a plurality of ribs, two handgrip blocks, and a seat cloth. The support frame bars each have a top end respectively affixed to the handgrip blocks and a bottom end respectively pivoted to the top end of the extension rod remote from the shaft. The ribs each have a first end and a second end. The first ends of the ribs are respectively pivoted to the support frame bars. The second ends of the ribs are respectively pivotally connected together. The seat cloth is fixedly connected between the handgrip blocks. When the handgrip blocks, the seat cloth, the support frame bars and the ribs are gathered together, the two handgrip blocks are abutted against each other with the seat cloth and the support frame bars and the ribs received therein, thereby forming a handgrip. When the handgrips and the eat cloth and the support frame bars and the ribs are extended out, the handgrip unit configures a seat for allowing the user to sit on the extended-out seat cloth. When the legs are gathered together, the locking ring is pulled downwards and sleeved onto the legs to hold the legs in the gathered status. When pulled the locking ring upwardly away from the legs, the legs and the links are forced by the push rod and the spring member to extend out and the extended links support the legs in the extended status.

Further, a light source is provided at the handgrip unit for illumination.

DETAILED DESCRIPTION OF THE PREFERRED EMBODIMENT

Figure 1:
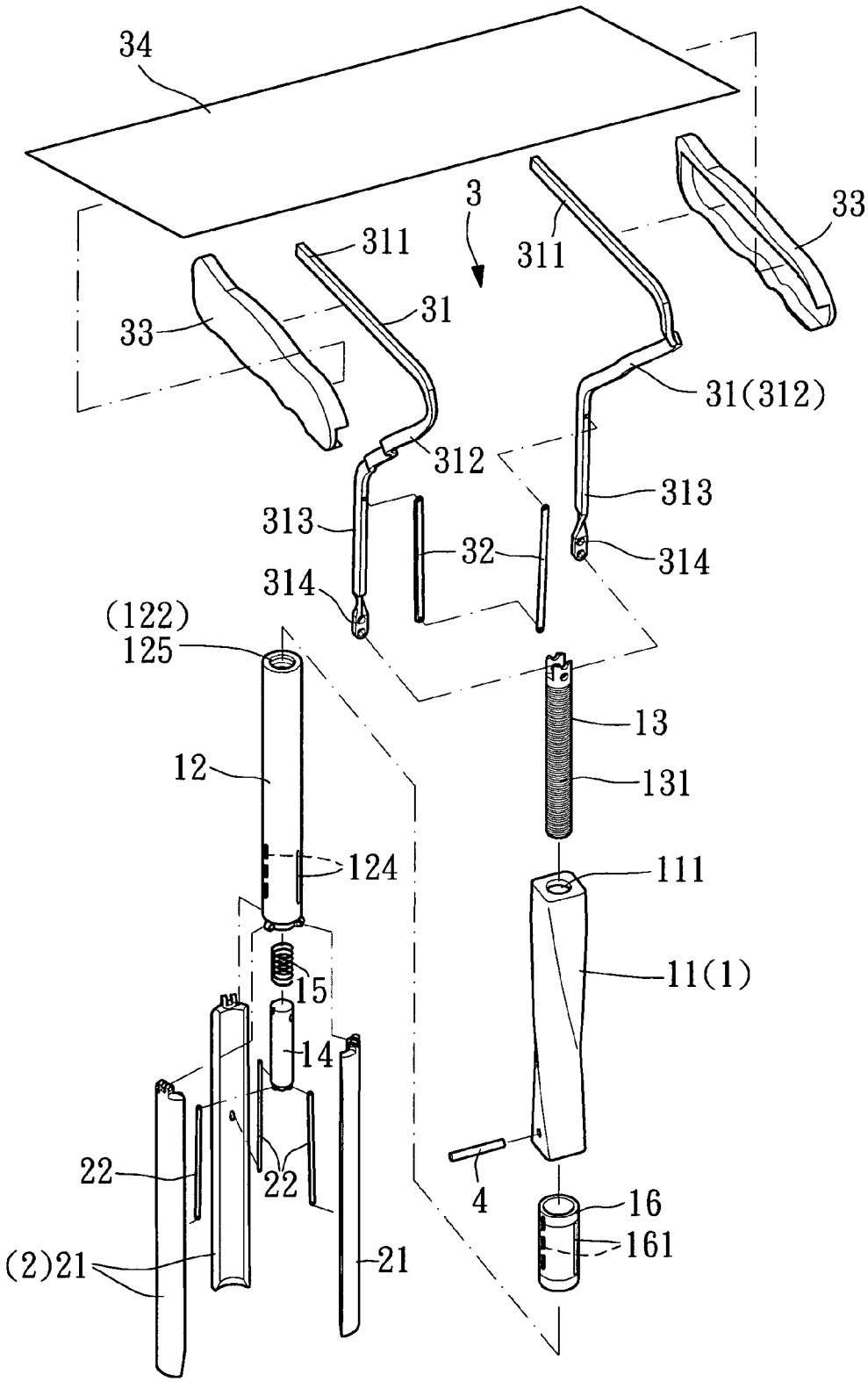
FIG. 1 is an exploded view of a dual-purpose cane according to the present invention.

Referring to the annexed drawings in detail, a dual-purpose cane in accordance with the present invention is shown comprised of a shaft unit 1, a footpiece unit 2, and a handgrip unit 3.

The shaft unit 1 (see FIG. 1) comprises a barrel 11, a shaft 12, an extension rod 13, a push rod 14, a spring member 15, and a locking ring 16. The barrel 11 is a double open-end sleeve having a top axial center hole 111 and a bottom axial center hole 112 axially connected in line and respectively extending through the top and bottom ends thereof (see FIG. 2). The bottom axial center hole 112 has a diameter greater than the top axial center hole 111. The shaft 12 is a tubular member mounted inside the barrel 11, having a transverse partition 121 that divides the shaft 12 into an upper part 122 and a lower part 123. The upper part 122 is adapted to receive the extension rod 13 for enabling the extension rod 13 to be moved in and out of the shaft 12. The spring member 15 and the push rod 14 are inserted in proper order into the lower part 123 of the shaft 12. The locking ring 16 is set in the bottom axial center hole 112 of the barrel 11 and sleeved onto the periphery of the lower part 123 of the shaft 12.

Figure 3:
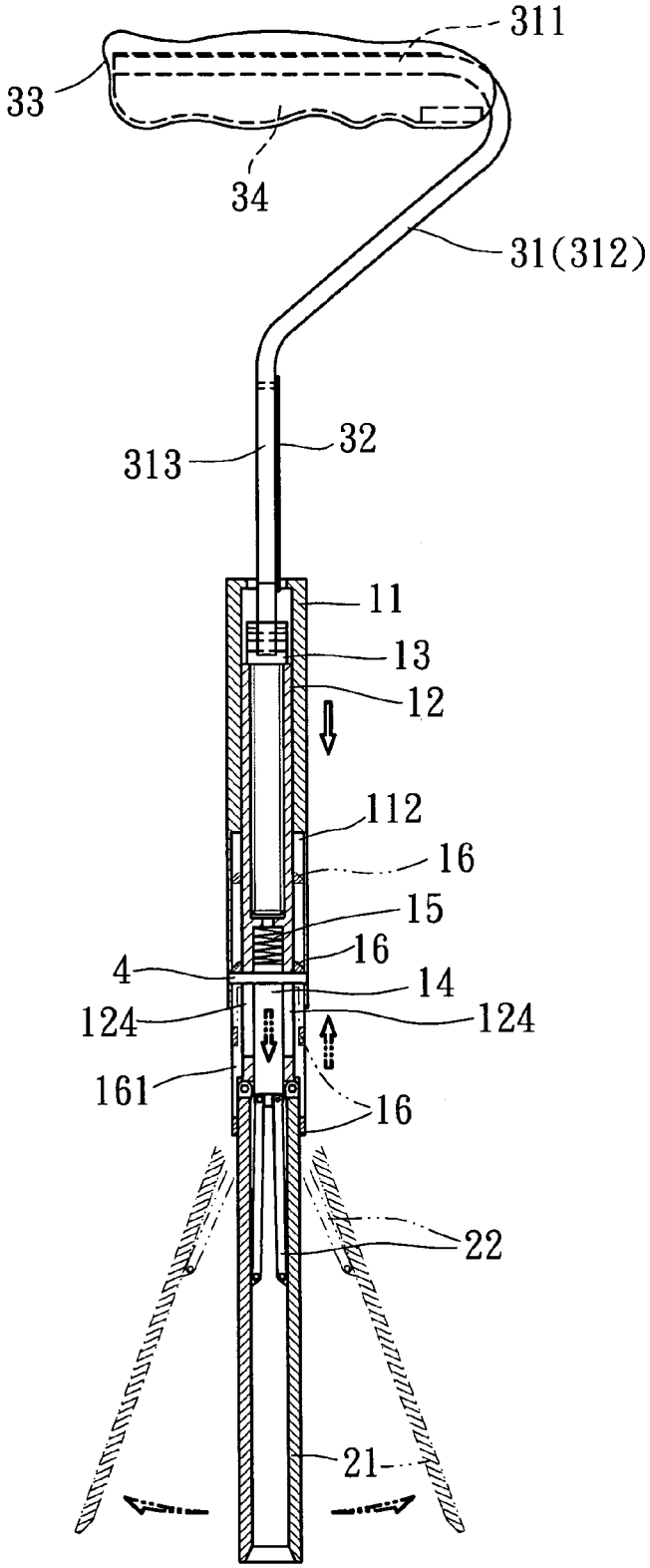
FIG. 3 is a schematic drawing of the present invention, showing the extending action of the footpiece unit of the dual-purpose cane.
Figure 4:
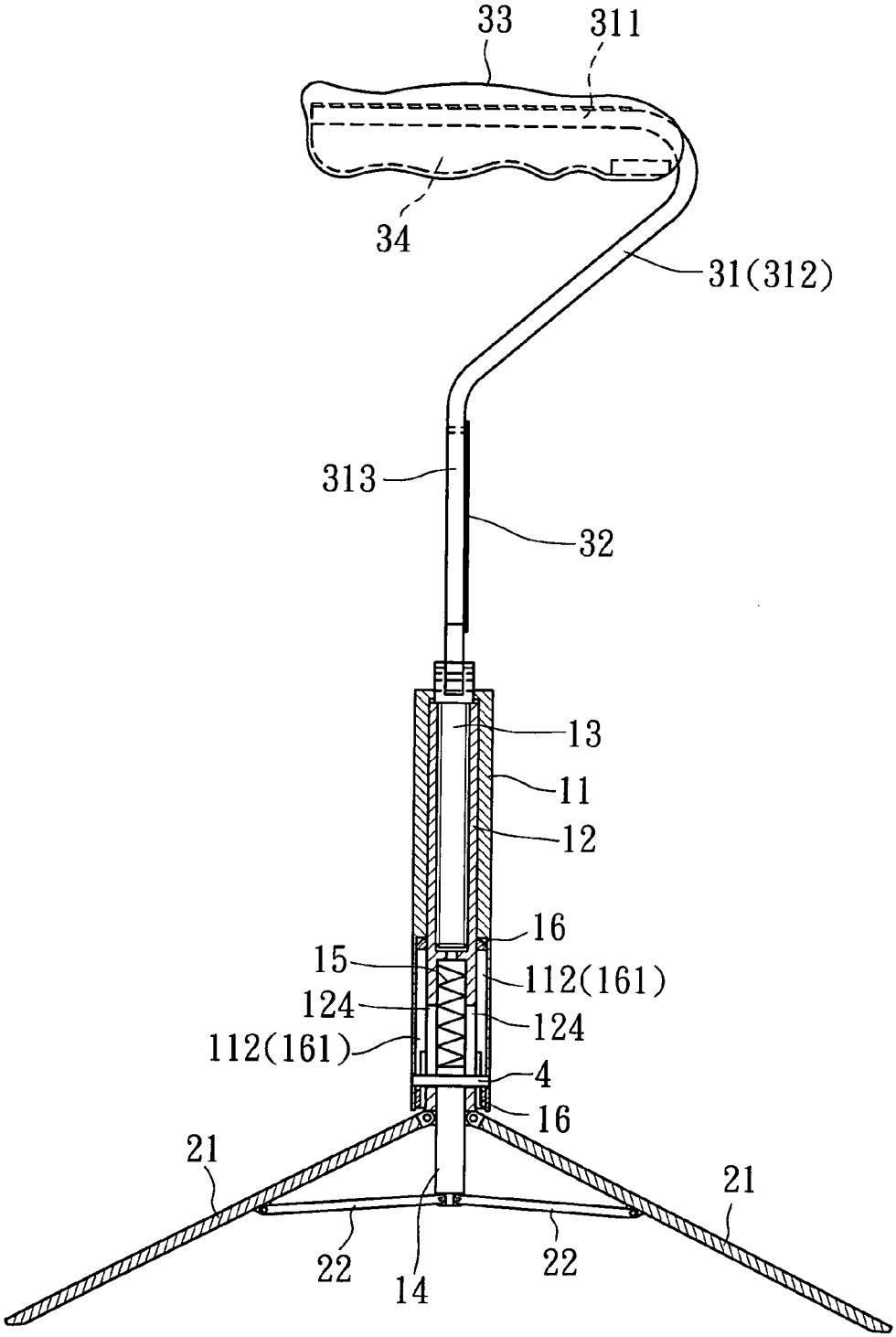
FIG. 4 is a sectional view of the present invention, showing the footpiece unit extended out.

Further, a pin 4 is transversely inserted through the barrel 11, the locating ring 16, the shaft 12, and the push rod 14. The shaft 12 has a longitudinal sliding slot 124 for the passing of the pin 4. The locking ring 16 has a longitudinal sliding slot 161 for the passing of the pin 4. Therefore, the locking ring 16 can be moved vertically upwards/downwards along the bottom axial center hole 112 of the barrel 11 (see FIGS. 3 and 4). Further, when the push rod 14 is pulled downwards, the pin 4 is moved with the push rod 14 relative to the shaft 12.

The footpiece unit 2 (see FIG. 1) comprises a plurality of legs 21 and a plurality of links 22. The legs 21 each have a top end respectively pivoted to the bottom end of the shaft 12. The links 22 each have a top end respectively pivoted to the bottom end of the push rod 14 and a bottom end respectively pivoted to the legs 21. When the legs 21 are gathered together, the locking ring 16 is pulled downwards and sleeved onto the legs 21 to hold the legs 21 together (see FIG. 2). When pulled the locking ring 16 upwardly away from the legs 21, the legs 21 and the links 22 are forced by the push rod 14 and the spring member 16 to extend out (see FIG. 3), and at the extended links 22 support the legs 21 in the extended status. At this time, the top end of each of the leg 21 is respectively stopped at the bottom end of the locking ring 16, and the pin 4 is forced downwards by the locking ring 16 and stopped against the bottom end of the longitudinal sliding slot 124 of the shaft 12, holding the legs 21 in the extended position (see FIG. 4).

The handgrip unit 3 (see FIG. 1) comprises two support frame bars 31, two ribs 32, two handgrip blocks 33, and a seat cloth 34. The support frame bars 31 each have a top end respectively affixed to the handgrip blocks 33, and a bottom end respectively pivoted to the top end of the extension rod 13. The ribs 32 each have a first end respectively pivoted to the support frame bars 31 and a second end pivoted to each other (see FIG. 5). The seat cloth 34 is fixedly connected between the two handgrip blocks 33. When the handgrip blocks 33, the seat cloth 34, the support frame bars 31 and the ribs 32 are gathered together, the two handgrip blocks 33 are abutted against each other with the seat cloth 34, the support frame bars 31 and the ribs 32 received therein, thereby forming a handgrip (see FIGS. 2 and 6). When the handgrips 33, the seat cloth 34, the support frame bars 31 and the ribs 32 are extended out, the handgrip unit 3 configures a seat for allowing the user to sit on the extended-out seat cloth 34.

Further, the upper part 122 of the shaft 12 has an inner thread 125 (see FIGS. 1 and 2), and the extension rod 13 has an outer thread 131 threaded into the inner thread 125 of the shaft 12. The user can rotate the extension rod 13 relative to the shaft 12 to adjust the elevation of the handgrip unit 3.

Figure 2:
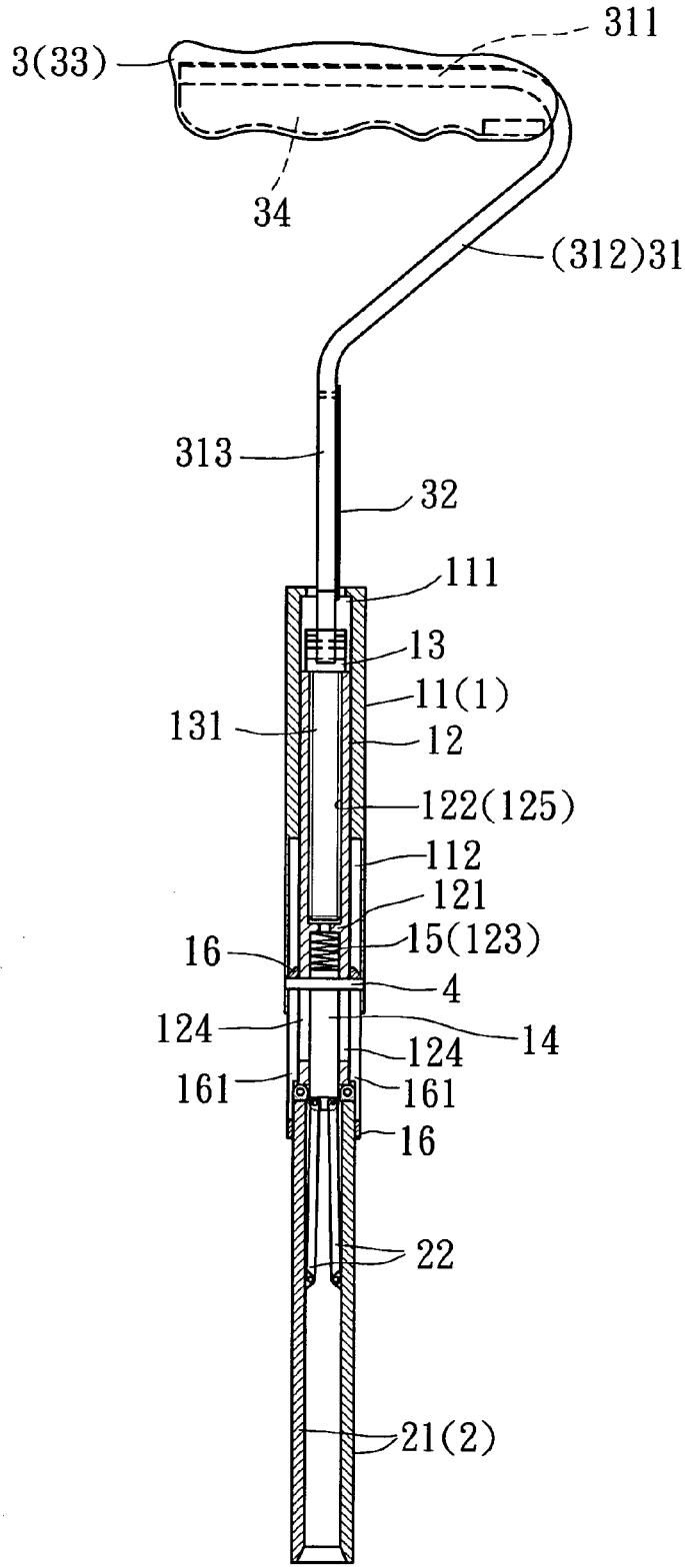
FIG. 2 is a sectional assembly view of the dual-purpose cane according to the present invention.
Figure 6:
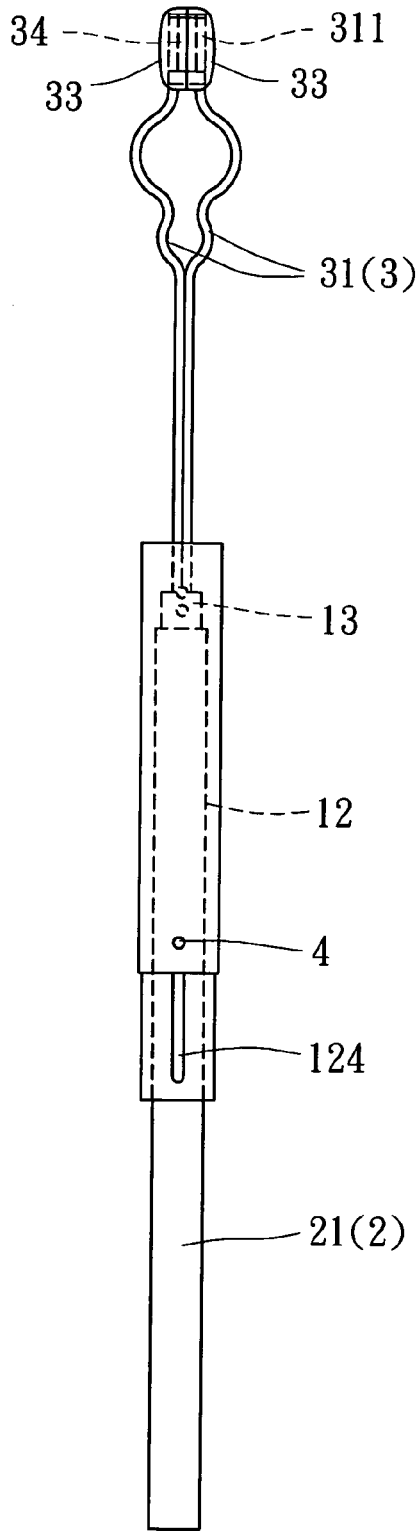
FIG. 6 is a sectional assembly view of an alternate form of the dual-purpose cane according to the present invention.
Figure 7:
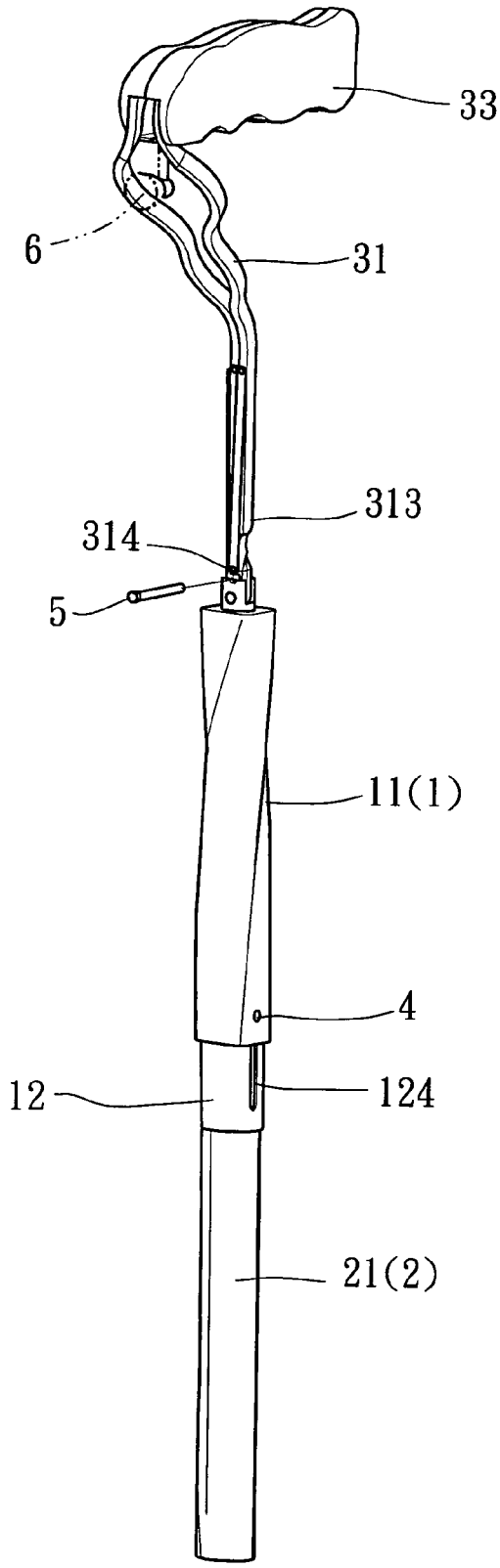
FIG. 7 is a schematic side view of the present invention, showing a pin fastened to the pinholes of the support frame bars of the handgrip unit.

Further, each support frame bar 31 has a horizontal top section 311, a vertical bottom section 313, and an oblique middle section 312 connected between the horizontal top section 311 and the vertical bottom section 313 (see FIGS. 1 and 2). The horizontal top section 311 is affixed to one handgrip block 33. The vertical bottom section 313 is pivoted to the top end of the extension rod 13. The two handgrip blocks 33 are so configured such that when the two handgrip blocks 33 are abutted against each other, the handgrip blocks 33 define therein a chamber for receiving the seat cloth 34 that is folded up. Further, the vertical bottom section 313 of each support frame bar 31 has a pinhole 314. When the parts of the handgrip unit 3 are received together, a pin 5 is inserted into the pinholes 314 of the support frame bars 31 to lock the handgrip unit 3, enabling the handgrip unit 3 to work positively as a handgrip. Further, a light source 6 may be provided at the handgrip unit 3 (see FIG. 7). Further, FIG. 6 shows an alternate form of the dual-purpose cane according to the present invention. This embodiment shows the same structure with the exception of the shape of the parts of the handgrip unit 3.

Figure 5:
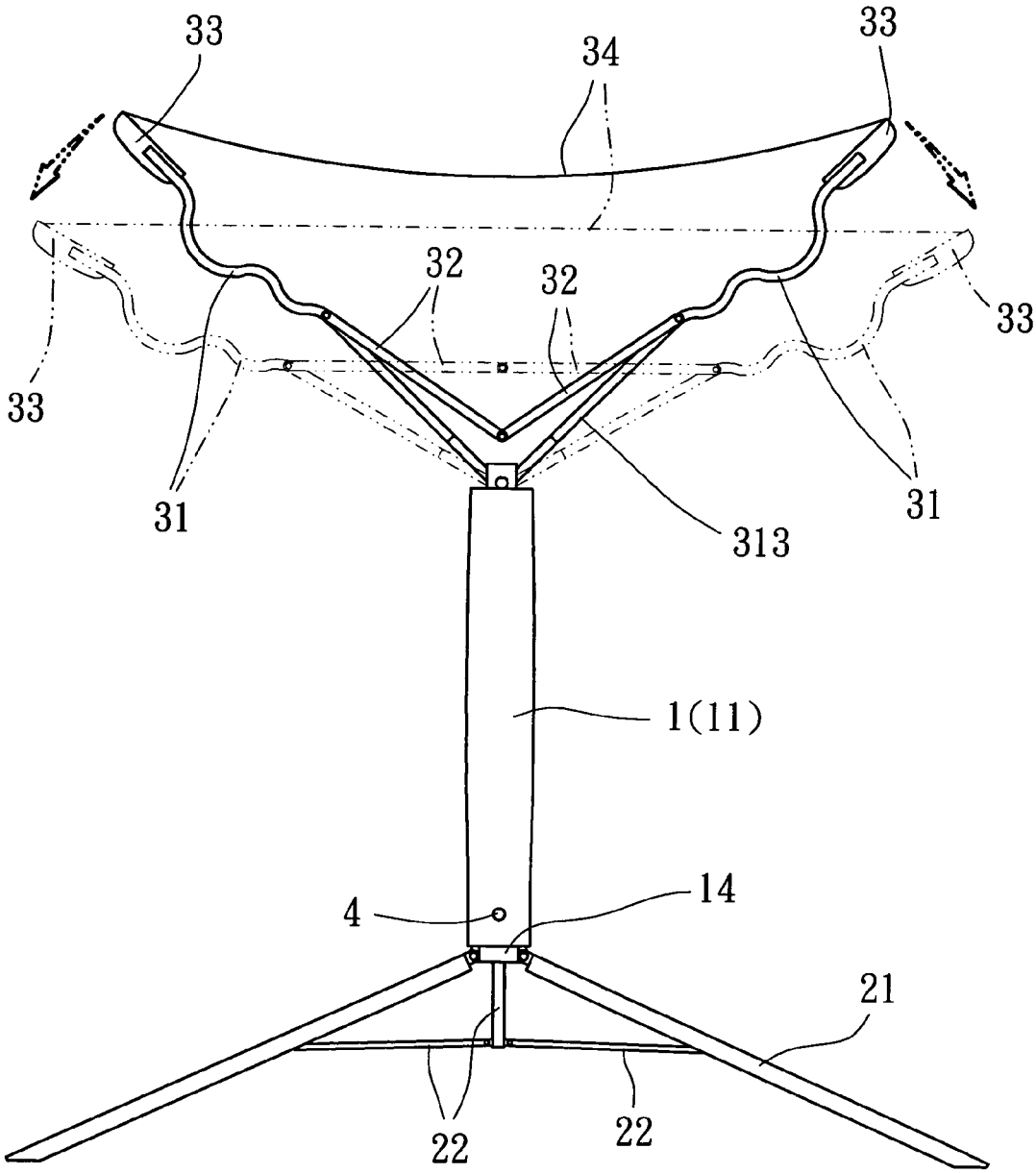
FIG. 5 is a schematic drawing of the present invention, showing the extending action of the handgrip unit of the dual-purpose cane.
Figure 8:
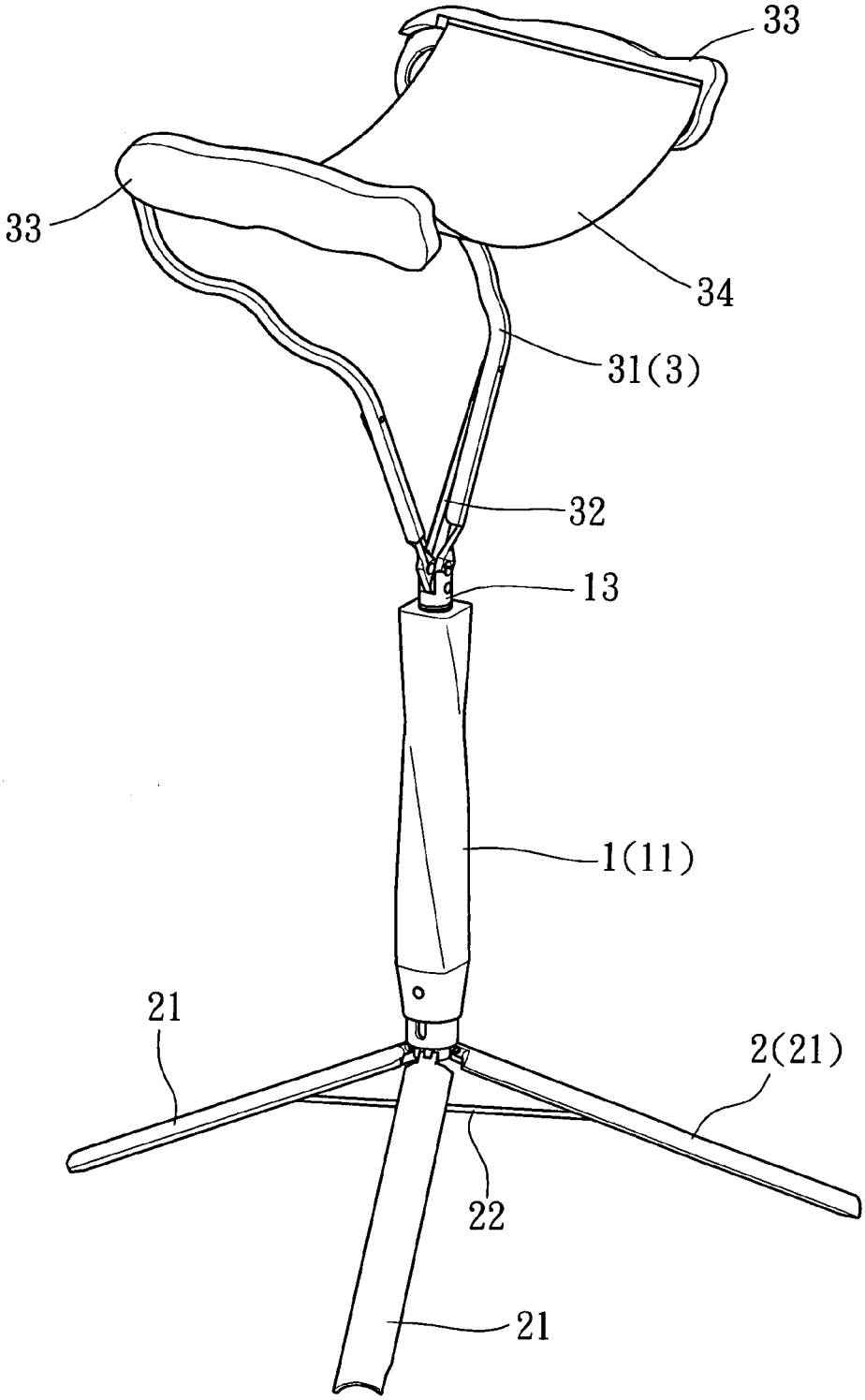
FIG. 8 is an elevational view showing the dual-purpose cane set in the mode of a chair according to the present invention.

When in use, the user can extend out the handgrip unit 1 and the footpiece unit 2, enabling the cane to be used as a chair (see FIGS. 5 and 8). When the handgrip unit 1 and the footpiece unit 2 are respectively set in the received position, the cane shows a single shaft configuration and can be used as a walking stick (see FIGS. 2 and 7).

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A cane comprising:

a shaft unit, said shaft unit comprising a barrel, a shaft, an extension rod, a push rod, a spring member, a locking ring, and a guide pin, said barrel having a top axial center hole and a bottom axial center hole axially connected in line and respectively extending through top and bottom ends thereof, said bottom axial center hole having a diameter greater than said top axial center hole, said shaft being a tubular member mounted inside said barrel and having an upper part, a lower part, and a transverse partition set between said upper part and said lower part, said lower part having a longitudinal sliding slot, said extension rod being coupled to the upper part of said shaft and axially movable relative to said shaft, said spring member being inserted into said lower part of said shaft and stopped at said transverse partition, said push rod being inserted into said lower part of said shaft and stopped at said spring member against said transverse partition, said locking ring having a longitudinal sliding slot and being set in the bottom axial center hole of said barrel and sleeved onto the periphery of the lower part of said shaft, said guide pin being transversely inserted through the longitudinal sliding slot of said shaft and the longitudinal sliding slot of said locking ring and fixedly connected with two distal ends thereof to said barrel;

a footpiece unit, said footpiece unit comprising a plurality of legs and a plurality of links, said legs each having a top end respectively pivoted to a bottom end of said shaft, said links each having a top end respectively pivoted to a bottom end of said push rod and a bottom end respectively pivoted to said legs; and a handgrip unit, said handgrip unit comprising a plurality of support frame bars, a plurality of ribs, two handgrip blocks, and a seat cloth, said support frame bars each having a top end respectively affixed to said handgrip blocks and a bottom end respectively pivoted to a top end of said extension rod remote from said shaft, said ribs each having a first end and a second end, the first ends of said ribs being respectively pivoted to said support frame bars and the second ends of said ribs being respectively pivotally connected together, said seat cloth being fixedly connected between said handgrip blocks;

wherein when said handgrip blocks, said seat cloth, said support frame bars and said ribs are gathered together, said two handgrip blocks are abutted against each other with said seat cloth and said support frame bars and said ribs received therein, thereby forming a handgrip; when said handgrips and said seat cloth and said support frame bars and said ribs are extended out, said handgrip unit configures a seat for allowing the user to sit on the extended-out seat cloth; when said legs are gathered together, said locking ring is pulled downwards and sleeved onto said legs to hold said legs in the gathered status; when pulled said locking ring upwardly away from said legs, said legs and said links are forced by said push rod and said spring member to extend out and the extended links support said legs in the extended status.

2. The cane as claimed in claim 1, wherein the upper part of said shaft has an inner thread; said extension rod has an outer thread adjustably threaded into the inner thread of said shaft.

3. The cane as claimed in claim 1, wherein said support frame bars each have a horizontal top section affixed to the associating handgrip block, a vertical bottom section connected to said extension rod, and an oblique middle section connected between said horizontal top section and said vertical bottom section.

4. The cane as claimed in claim 3, wherein the vertical bottom section of each of said support frame bars has a pinhole for receiving a pin to lock said support frame bars.

5. The cane as claimed in claim 1, wherein said two handgrip blocks are so configured such that when said two handgrip blocks are abutted against each other, said handgrip blocks define therein a chamber for receiving said seat cloth.

6. The cane as claimed in claim 1, wherein said seat cloth is a wrinkled cloth.

7. The cane as claimed in claim 1, further comprising a light source provided at said handgrip unit.

* * * * *